United States Patent [19]

Wormald et al.

[11] 4,332,502

[45] Jun. 1, 1982

[54] APPARATUS FOR USE IN DRILLING

[75] Inventors: Philip J. Wormald; Raymond J. Clemmow, both of Dronfield, England

[73] Assignee: Padley & Venables Limited, Yorkshire, England

[21] Appl. No.: 861,678

[22] Filed: Dec. 19, 1977

[30] Foreign Application Priority Data

Jan. 11, 1977 [GB] United Kingdom ..... 926/77
Mar. 29, 1977 [GB] United Kingdom ..... 13114/77
Mar. 30, 1977 [GB] United Kingdom ..... 13386/77

[51] Int. Cl.[3] ..... E21B 17/02
[52] U.S. Cl. ..... 403/343; 403/347
[58] Field of Search ..... 403/343, 307; 285/334, 285/390

[56] References Cited

U.S. PATENT DOCUMENTS 3,388,935 6/1968 Hjalsten et al. ..... 403/343
3,645,570 2/1972 Johansson et al. ..... 403/307
3,717,368 2/1973 Czarnecki et al. ..... 403/343
3,822,952 7/1974 Johansson et al. ..... 403/343

FOREIGN PATENT DOCUMENTS 1326345 8/1973 United Kingdom .

*Primary Examiner*—Andrew V. Kundrat
*Attorney, Agent, or Firm*—McCormick, Paulding & Huber

[57] ABSTRACT

A drill element in the form of a drill rod, a sleeve for coupling together two drill rods or a drill bit; the drill element having a single start internal or external cylindrical screw thread by which it is intended to be coupled to a further drill element in the assembly of a drill string for percussion or rotary/percussion drilling.

19 Claims, 4 Drawing Figures

1
2
3
4
5
6
7
12
13
14
15

1
2
3
3'
4
4'
5
5'
6
7
7'
8
9
10
11
P
x
y
h
h/2
ε
c
c'

APPARATUS FOR USE IN DRILLING

This invention relates to apparatus for use in drilling by percussion or rotary/percussion techniques. More particularly the invention is concerned with a drill element in the form of a drill rod, a sleeve for coupling together two drill rods or a drill bit; the drill element having a single start internal or external cylindrical screw thread by which it is intended to be coupled to a further drill element in the assembly of a drill string for percussion or rotary/percussion drilling, such form of drill element will hereinafter be referred to as "of the kind specified".

When an external screw thread of one drill element mates with a complementary internal screw thread of a second drill element, in accordance with conventional design of screw threads a clearance is provided between opposing roots and crests of the respective threads and also between opposing flanks (herein referred to as "secondary flanks") on one side of the thread form while opposing flanks (herein referred to as "main flanks") on the other side of that thread form are in abutment. More particularly in the context of the present invention the main flanks are those flanks on the respective two drill elements which, upon the application of a screwing torque and when the first drill element is restrained at its leading end from further entry into the second drill element, are urged into face-to-face abutment with each other so that the reaction therefrom results in the screw threaded wall of the second drill element being tensioned. Having this latter characteristic in mind, and by way of example, when the ends of two drill rods are coupled together by a tubular sleeve so that the external screw threaded ends of the drill rods mate respectively with complementary internal screw threads provided in opposite ends of the sleeve so that leading end faces of the drill rods abut firmly against each other within the sleeve, then upon further tightening of the drill rods in the coupling or joint thus formed, the axial thrust which is imparted through the abutting main flanks between the thread of the sleeve and the threads of the drill rods will impart a reaction to the sleeve causing the latter to be tensioned while the abutting end faces of the drill rods are maintained under compression within the joint.

In the art of percussion drilling, especially rotary percussion where a drill bit may be subjected to a continuous or intermittent rotation while being impacted, the desirability of having high drilling rates results in the introduction of new percussion drilling machines having high, and ever increasing, energy outputs with appropriately increasing rotating torques. In a percussion drilling operation the hole is deepened by successive connection together of drill rods usually having a male thread at each end which is connected to an adjacent drill rod in the formation of a drill string by a tubular sleeve having a female thread. Alternatively a drill string can be formed by successive connection together of drill rods each having a male thread at one end and a complementary female thread at the other end so that the rods are joined in male/female relationship. However, during the drilling process it is possible for the energy of impact from the percussive blows and the rotating torque (both of which are transmitted through the drill string from the drilling machine to the drill bit) to cause the threaded joints to become tightly locked together so rendering them extremely difficult to uncouple when required. Consequently as the rotating torque increases with the introduction of higher energy drilling machines it becomes increasingly difficult to uncouple the drill elements in the drill string after prolonged use. There is a direct relationship between the torque required to uncouple the drill elements in a drill string and the torque by which they are tightened. Furthermore however, the impact which is applied by a drilling machine to a drill rod generates stress waves some of which are propogated with the speed of sound along the drill rod. The initial primary stress wave is of a compressive nature thereby tending to shorten the drill rod; as this wave reaches the end of the drill rod, if there is no other drill rod in contact with it, the wave is reflected and changes its sound to a tensile wave. If there is another drill rod tightly coupled with the first drill rod in a drill string, then most of the compressive stress wave is transmitted across the joint at the coupling and into the second drill rod and so the compressive stress wave may be transmitted successively through the drill rods along the drill string to the bit at the end thereof. The proportion of the stress wave which is transmitted and which is reflected at each of the joints (usually formed by the coupling sleeves as aforementioned) in the drill string depends upon the tightness or otherwise of the joint system. Furthermore, when the compressive stress wave reaches the drill bit, if the bit is urged into contact with the rock face, then the majority of the compressive wave is taken from the bit and transmitted to the rock. Alternatively, if the drill bit is not in contact with the rock face or is loosely applied thereto, then the majority of the compressive wave may be reflected along the drill string as a tensile wave. In practice because of limitations in the jointing systems and in the feed provided by the drilling machine (which latter occasionally permits poor contact between the drill bit and the rock face) it is found that there are a considerable number of reflections from the primary compressive wave which, on transmission through each of the joints in the drill string, generate alternate push-and-pull axial forces in the drill string. These latter forces create alternate high pressure contact and minute separations of the opposing surfaces which, theoretically, are intended to abut each other constantly in the drill rod and sleeve combinations. As a result of the friction which occurs between the relatively moving parts in the joints during the application of the aforementioned push-and-pull forces, the joints become heated—in fact it occasionally happens that a joint becomes welded by this heating effect. Whilst ensuring that a joint will provide efficient transmission of energy along a drill string and also alleviate the problem of over heating, it is important to ensure that the mating screw threads of a joint neither become wedged together in use (so adding to the problem of uncoupling and possibly resulting in bursting of the joint) nor run too loosely so that there is a possibility of the joint unscrewing inadvertently during use.

For many years it was accepted that rotary percussive drilling machines would use a relatively low operating torque in the order of 150 lbs feet; in more recent years however drilling machines with an operating torque in the order of 250 to 800 lbs feet have been introduced to provide increased drilling speeds. The result of uprating the drilling torque was that the screw threads on the drill elements regarded as acceptable for use with low torque machines were found to be inefficient when used on the high torque machines due to the problems above mentioned.

It has been found that the aforementioned heating problem may be alleviated by co-relating the geometrical configuration of the main flanks with the effective diameter of the screw thread so that the reaction from the abutting main flanks in a male/female coupling can maintain the female element in tension and the abutting end face or faces of the male element or elements in compression to the extent that the separation forces from the aforementioned push-and-pull characteristic are resisted while the force per unit area which is transmitted across the abutting main flanks in the coupling is balanced to the extent that the separation movements which may occur do not result in an unacceptable heating effect. In developing a screw thread which, in use, will provide the aforementioned desirable characteristics it is believed necessary to relate the flank angle with the pitch angle (and thereby with the effective diameter) whereby the correct selection of the former alleviates the possibility of a wedge effect developing between abutting main flanks in a male/female coupling and correct selection of the pitch angle permits the screw thread to be of a form which provides adequate strength for its intended purpose.

It is internationally accepted that the screw thread of a drill element of the kind specified should have a root and a crest interconnected through a main flank and, usually, an effective diameter which is selected from the range 25 mms to 65 mms (and preferably in the range 29 mms to 65 mms for use with high torque drilling machines); to provide adequate surface area for the transmission of energy across a joint formed by a coupling it is desirable that the main flank is flat, or substantially flat, in a section of the screw thread taken on the longitudinal axis thereof and is inclined at a flank angle $\beta$ to a plane which is normal to the longitudinal axis of the thread. Many screw threads of this general form have hitherto been proposed but when applied to drill elements of the kind specified and used with high torque drilling machines they have tended to suffer from the previously discussed problems (even though such drill elements would operate under high torque their life expectancy is usually far less than that considered reasonable and they are regarded as impractical, for example, due to the difficulty of unscrewing after use). During our development of a drill element for use with high torque machines we discovered that there is a desirable range of flank angle $\beta$ and that a particular relationship exists by which the pitch angle of the thread may be determined for a particular angle $\beta$ which is selected from the specified range. The particular relationship which we discovered between the flank angle and the pitch angle stemmed from our appreciation that when the drill elements are used in a drilling machine there is a desirable ratio between the torque necessary to uncouple two screw threadedly connected drill elements (TU) and the torque necessary to couple together those elements (TC) and that this ratio should be maintained substantially constant irrespective of variations in pitch angle or flank angle which are selected for the screw threads. Developing from this we determined that the screw thread of a drill element of the kind specified with an effective diameter selected from the range 25 mms to 65 mms and having a root and crest interconnected through a main flank which is flat (or substantially so) and inclined at the flank angle $\beta$ as aforementioned, preferably has a ratio between the uncoupling torque and the coupling torque (TU/TC) of substantially 0.39. Developing from this knowledge of the preferred ratio TU/TC we found that the particular pitch angle for a preselected flank angle $\beta$ should lie within the range $\alpha \pm 0.3°$, $\alpha$ being determined from the equation:

$$\sin 2\alpha = \frac{0.24 \cos \beta}{(0.056 + 1.39 \cos^2 \beta)}$$

For the avoidance of doubt, the tangent of the pitch angle $\alpha$ for a particular thread is the ratio of the pitch to the circumference of that thread at the effective diameter thereof. Further, throughout the present specification and appended claims, the "effective diameter" is considered as the diameter of the screw thread taken on a plane section which includes the longitudinal axis of the thread and which diameter is measured across the main flank between the radially mid point positions of the region of the main flank over which region it is intended to be in abutment with an opposing main flank.

By this discovery we found it possible to provide a screw thread on a drill element which would be reasonably efficient for use with high torque rotary percussive drilling machines irrespective of the flank angle $\beta$ which is selected from a given range; our initial development work indicated that the range for the flank angle $\beta$ should be 40° to 50°. It is our belief that this particular discovery is a considerable breakthrough in the art of screw thread design for drill elements where, as far as we are aware, it has hitherto been the practice for each particular form of screw thread to be designed and developed for a particular size of drill element and there was no interrelationship between the effective diameter, flank angle and pitch angle for all of the various sizes of drill elements capable of being used in a particular drilling machine (in other words although a drill element of the kind specified and having a screw thread of one effective diameter may have been found efficient for use in rotary percussive drilling, it was necessary to apply practical experience and a considerable amount of guess work in assessing whether any of the geometrical features in the screw thread of that drill element would likely be efficient if applied to another drill element having a different effective diameter of screw thread).

Further development work on the invention has led us to the discovery that the relationship between the uncoupling torque and coupling torque (TU/TC), the flank angle $\beta$ and the pitch angle can be broadened to include a wider range of screw thread forms which will provide commercially useful drill elements of the kind specified, the screw thread of each of which will have an effective diameter selected from the range 25 mms to 65 mms. In particular we have now discovered that the ratio between the uncoupling torque to the coupling torque (TU/TC) although preferably 0.39 may be within the range 0.36 to 0.46 provided that the flank angle $\beta$ and corresponding pitch angle are maintained within the "bounds of utility". So that this latter phrase can be appreciated, we have found that the flank angle $\beta$ should not be greater than 65° (and is preferably not greater than 60°) nor less than 30° while the pitch angle should not be less than 4.5° nor greater than 9.5°. Our reasoning for this is that (a) during use of a coupling formed by the mating screw threads of two drill elements of the kind specified in which the flank angles $\beta$ are greater than 65°, such coupling is subjected to very high wedging forces which can cause transverse bursting of the drill element having the female thread; (b) a drill element in which the flank angle $\beta$ of its thread is less than 30° presents manufacturing problems from the point of view of the difficulty of machining a thread with a coarse pitch and steeply inclined main flank; (c) a pitch angle less than 4.5° is believed to result in a thread form having insufficient cross sectional strength for rotary percussive drilling purposes whereby it is likely that the thread will shear off in use (particularly if percussive drilling commences while the coupling is loose) and (d) a pitch angle greater than 9.5° is believed to be unsuitable for a single start thread in view of the difficulty of achieving adequate surface or wear area on the main flank (so that it becomes desirable to use multi-start threads).

In accordance with the present invention therefore there is provided a drill element of the kind specified in which the screw thread has a root and a crest which are interconnected through a main flank, an effective diameter selected from the range 25 millimeters to 65 millimeters and a pitch angle $\alpha$ and in which, in a section of the screw thread taken on the longitudinal axis thereof, the main flank is flat or substantially flat and is inclined at a flank angle $\beta$ to a plane which is normal to the longitudinal axis and wherein $\alpha$ is determined, or substantially so, from the formula:

$$\sin 2\alpha = \frac{-0.4 \cos\beta \left(\frac{TU}{TC} - 1\right)}{(0.04 + \cos^2\beta)\left(\frac{TU}{TC} + 1\right)}$$

where TU/TC is in the range 0.36 to 0.46; $\beta$ is in the range of 30° to 65°, and $\alpha$ as determined is not greater than 9.5°.

Further in accordance with the present invention there is provided the combination of two drill elements each of which is as specified in the immediately preceding paragraph, a first of said drill elements having its screw thread internal and the second drill element having its screw thread external, said screw threads being complementary and engageable, or in engagement, with each other so that the main flank of one drill element opposes and is capable of, or is in, substantially face-to-face and sliding abutment with the main flank of the other drill element.

As previously discussed $\beta$ is preferably in the range 30° to 60° and more preferably $\beta$ is in the range 40° to 50°; in this latter range of $\beta$ it is desirable that TU/TC is 0.39° and that the pitch angle $\alpha$ is as determined from the formula with a tolerance in the range ±0.3°.

It is believed that the drill element in accordance with the present invention will have a screw thread form which satisfies, or contributes considerably towards satisfying, aforementioned desirable characteristics whereby with a flank angle selected from the range 30° to 65°, the appropriate pitch angle may be determined (with an acceptable tolerance) from the previously given formula. For example, at the ends of the most preferred range of $\beta$, a flank angle $\beta$ of 40° can have a pitch angle $\alpha$ of 6.1° and a flank angle $\beta$ of 50° can have a pitch angle $\alpha$ of 7.1°. Preferably the flank angle $\beta$ is 45° and the pitch angle $\alpha$ is 6.5° and this relationship can be utilised for screw threads of all effective diameters selected from the range 25 millimeters to 65 millimeters.

It is desirable that the helical surface area over which the opposing main flanks in a male/female coupling will abut is related to the effective diameter of the screw threads so that the area and inclination of such abutment provides a required axial reaction for the compression/-tensile effect on the male/female element respectively and appropriate force transmission per unit area to alleviate the development of unacceptable heat as previously mentioned. With this in mind it is preferred that the extent or height (h±10%) measured radially over which the opposing main flanks will abut in a male/-female coupling of drill elements in accordance with the present invention is determined, or substantially so, from $$h = 8.06\times10^{-6}\phi^3 - 2.8\times10^{-3}\phi^2 + 0.27\phi - 5.07$$

where $\phi$ is the effective diameter in millimeters.

Conveniently the surfaces of the crest and root of the thread form are flat, or substantially so, in a section of the screw thread taken on the longitudinal axis thereof so that the crest and root lie in the surfaces of notional cylinders which are concentric with the thread axis. However since it is not intended that the respective crests and roots in a male/female coupling will be in abutment the surface formations of the crest and root is not particularly relevant so that, for example, they may be of concave or convex arcuate profile. The crest extends between the main flank and a secondary flank which, in the context of the present invention, may normally be regarded as non-abutting (that is when the opposing main flanks of co-operating male and female screw threads are in abutment). Since the secondary flank will not usually be in abutment it is not considered essential that this flank will take a particular form. However, in conditions of use where a coupling may not be tightened sufficiently for opposing main flanks to be in abutment and with the appropriate drill elements in compression and tension as previously discussed, upon the drill string being impacted the energy of such impact may result in the opposed secondary flanks being urged into abutment with each other until such time as the coupling is tightened (which usually occurs automatically as a result of the drill string being rotated). Consequently the secondary flank may have to transmit pressure impulses through the coupling and be of such form as will alleviate the difficulties usually associated with the main flank. It is therefore preferred that the secondary flank is flat, or substantially flat, in a section of the screw thread taken on the longitudinal axis thereof and is inclined at a flank angle $\gamma$ to a plane which is normal to the longitudinal axis of the screw thread. The flank angle $\gamma$ is preferably selected from the range 30° to 65°; conveniently the flank angle $\gamma$ is the same as the flank angle $\beta$ and the pitch of the thread form is substantially symmetrical in the axial direction about the mid axial-width position of the crest.

It is preferred that transition regions are provided on the screw thread between the main flank and the adjacent crest, between the main flank and the adjacent root, between the secondary flank and the adjacent crest and between the secondary flank and the adjacent root which transition regions are of a chamfered or fair curved profile to alleviate the formation of an abrupt change in direction of the thread surface. The transition regions are preferably radiussed to provide convex surfaces between the crest and adjacent flanks and concave surfaces between the root and adjacent flanks, for the drill element sizes of the present invention the radii of such transition regions is preferably selected from the range 1.5 millimeters to 3.5 millimeters. By providing such formations to the transition regions there is alleviated the possibility of creating regions of excessive hardness which may otherwise be formed, for example at an abrupt edge part between the main flank and crest, on the screw thread when the latter is carburised. To maintain adequate surface area of abutment for the main flank it is desirable that at least the curved or chamfered transition regions which extend from the main flank should be as small as possible consistent with effective clearances being provided between the appropriate regions of mating complementary male and female thread forms. When the transition regions are of arcuate profile it is preferred that the radii of curvature of such regions are considerably less than the radial depth of the thread.

Embodiments of drill elements constructed in accordance with the present invention will now be described, by way of example only, with reference to the accompanying illustrative drawings in which.

Figure 1:
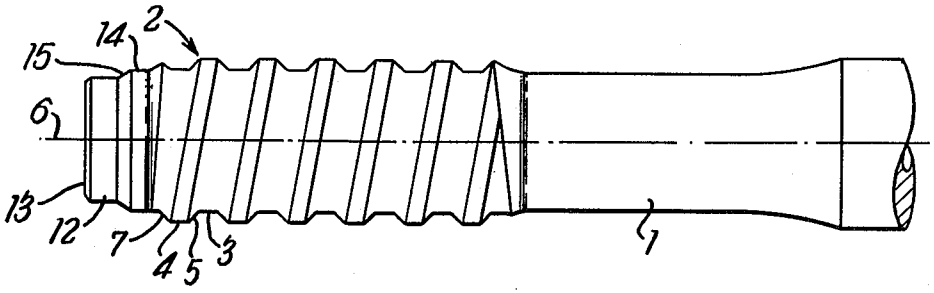
FIG. 1 is a side elevation of an end part length of a drill rod constructed in accordance with the invention and illustrates the male screw thread thereon.
Figure 3:
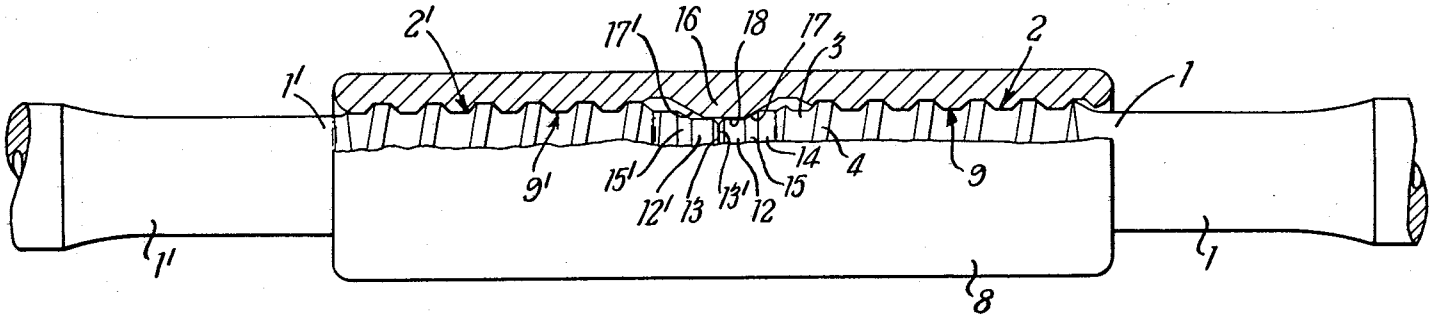
Figure 4:
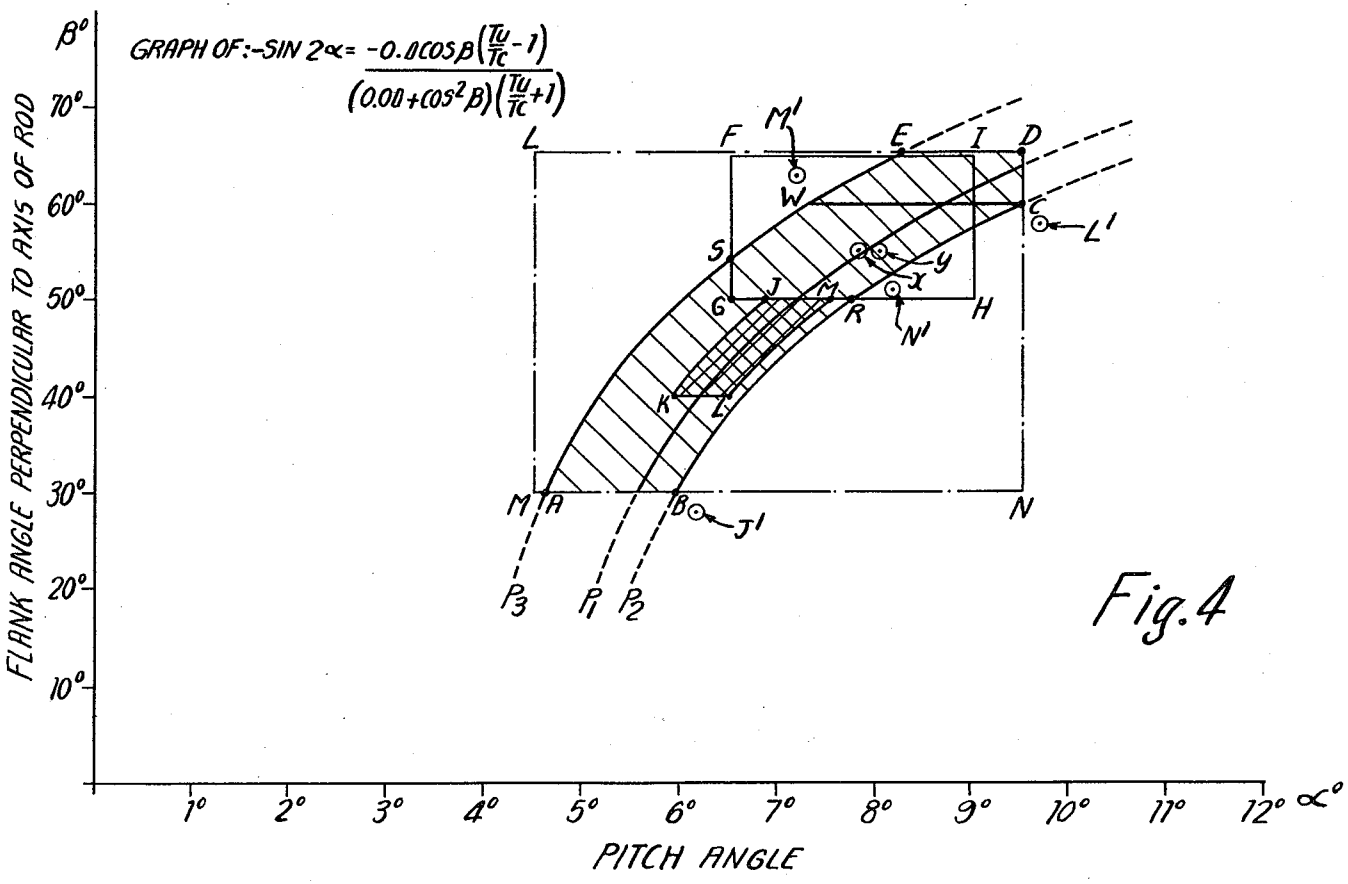

FIG. 3 is a side elevation of two drill rod end part lengths each of which is similar to that shown in FIG. 1, the drill rods being shown coupled together by a sleeve which is shown in part section, and FIG. 4 is a graph illustrating the relationship between the flank angle $\beta$ ($\beta$ being measured from a plane which is perpendicular to the axis of the screw thread) and the pitch angle $\alpha$, the curved lines $P_1$, $P_2$ and $P_3$ each being drawn in accordance with the equation:

$$\sin 2\alpha = \frac{-0.4 \cos\beta\left(\left(\frac{TU}{TC}\right) - 1\right)}{(0.04 + \cos^2\beta)\cdot\left(\frac{TU}{TC} + 1\right)}$$

Where possible throughout the following description the same parts or members in each of the Figures have been accorded the same references.

The drill rod 1 shown in FIG. 1 is formed from tubular steel rod the major extent of which will usually be of circular or polygonal shape in lateral section. Each end part length of the rod is provided with an external, or male, (usually lefthanded) screw thread 2 by which the drill rod is intended to be jointed to a further drill rod through a coupling sleeve or to a drill bit in the formation of a drill string in accordance with conventional practice. The screw thread 2 is single start and has a root 3 and a crest 4 which are interconnected through a main flank 5. In section of the screw thread taken on its longitudinal axis 6, the main flank 5, the root 3 and the crest 4 are flat so that the helical surfaces 3 and 4 are respectively located in notional cylinders which are concentric with the axis 6; furthermore the main flank 5 is inclined at an angle $\beta$ (FIG. 2) to a plane which is normal to the axis 6.

Extending from the crest 4 on the side thereof axially remote from the main flank 5 is a secondary flank 7 which extends to the adjacent root 3. In section of the screw thread taken on the axis 6 thereof the secondary flank 7 is flat and is inclined at a secondary flank angle $\gamma$ to a plane which is normal to the axis 6.

Figure 2:
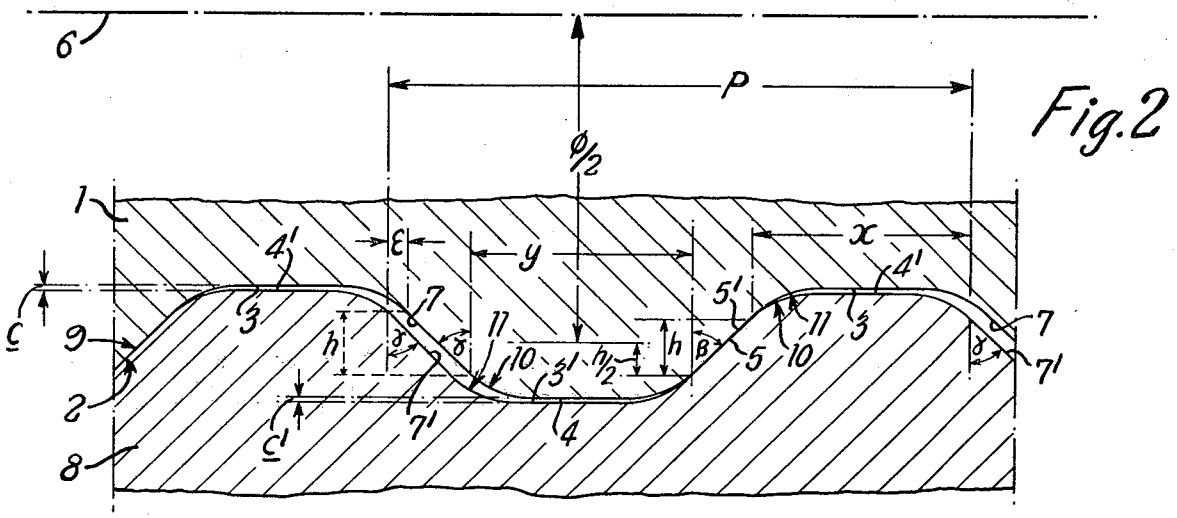
FIG. 2 is an enlarged section of part of the screw thread of the drill rod in FIG. 1 which section is taken on the longitudinal axis of the screw thread, the male thread on the drill rod being illustrated in engagement with a complementary female thread of a further, partly shown, drill element in the form of a coupling sleeve or a drill bit.

To form a joint between the drill rod as shown in FIG. 1 and either an adjacent drill rod (for extending a drill string) or a drill bit at the end of a drill string, the screw threaded end 2 of the drill rod is mated with a complementary female thread provided in a coupling sleeve or a socket of a drill bit as required. FIG. 2 shows an axial section through part of the drill rod in FIG. 1 mated with a complementary female thread 9 provided in what will conveniently be regarded as a coupling sleeve 8. The screw thread 9 in the sleeve 8 is single start and has a root 3' and a crest 4' which are interconnected through a main flank 5'. As is shown in the section of FIG. 2, the root 3' and crest 4' are substantially parallel with the opposing crest 4 and root 3 respectively of the rod screw thread 2 and the main flank 5' is flat and inclined at the same flank angle as the main flank 5 which it opposes. Similarly the screw thread 9 has a secondary flank 7' which opposes and is parallel with the secondary flank 7.

As the rod 1 is screwed into the sleeve 8 the helical main flank 5 engages and slides over the complementary helical main flank 5' with such flanks in substantially face-to-face abutment while, in accordance with conventional design of screw threads radial clearances "C" and "C'" (which are not necessarily equal) are provided between the opposing crests and roots 3 and 4' and 3' and 4 respectively. In addition clearance is provided between the helical faces of the opposed secondary flanks 7 and 7', such clearance between these faces in an axial direction being known as "endfloat" and indicated in FIG. 2 by $\epsilon$. By ensuring that, upon correct mating of the screw threads, only the opposed main flanks 5 and 5' are in abutment there is alleviated the possibility of the screw threads binding.

It will be noted from FIG. 2 that both crests 4 and 4' communicate with their respectively adjacent flanks 5, 7 and 5', 7' through convex transition regions 10 formed by radiussing the material of the thread. Also both roots 3 and 3' communicate with their respectively adjacent flanks 5, 7 and 5', 7' through concave further transition regions 11 formed by radiussing the material of the thread. To provide a relatively large surface area for the main and secondary flanks it is preferred that the radii of curvature for the transition regions 10 and 11 are smaller than the overall radial depth of the thread and for the larger diameter thread sizes the radii of curvatures 10, 11 may be in the order of half the overall radial depth of the thread. The radii of curvature of the concave and convex transition regions may be the same or each convex region 10 may have a slightly greater radius of curvature than that of the respectively opposing concave region 11 provided that it is ensured clearance is maintained between the opposing screw threads 2 and 9 over the aforementioned transition regions.

With the screw threads 2 and 9 correctly mated as shown in FIG. 2 so that the opposing main flanks 5 and 5' are in face-to-face abutment, the screw threads have the same effective diameter indicated by $\phi$. In the context of the present invention the effective diameter is regarded as the diameter of the screw thread taken on a plane section which includes the longitudinal axis 6 (as shown in FIG. 2) and measured across the mid points of the radially extending regions over which the main flanks 5 and 5' are in abutment. In FIG. 2 the radial extent of abutment between the main flanks 5 and 5' is indicated at "h" so that half of the effective diameter ($\phi/2$) is the radial distance from the axis 6 to the radial mid point of "h". Because of the clearances "C" and "C'" which are provided between the opposing screw threads 2 and 9 the actual extent of each of the main flanks 5 and 5' will be greater than the extent over which they are in face-to-face abutment so that in FIG. 2 the main flank 5 will extend upwardly beyond the main flank 5' while the latter extends downwardly beyond the main flank 5.

The present invention is specifically directed to drill elements in which the effective diameter $\phi$ is selected from the range 25 millimeters to 65 millimeters (and preferably in the range 29 mms to 65 mms), and the flank angle $\beta$ of the main flanks 5 and 5' is selected from the range 30° to 65° (and more preferably from the range 30° to 60°). To provide an improved joint between the screw threads 2 and 9 of the respective drill elements whereby the coupling thus formed will tend to alleviate the effect of the opposing main flanks 5, 5' from moving out of abutment with each other during the transmission of energy through the coupling (as a result of the impacts which are applied to the drill string) and thereby reduce the energy loss which tends to occur as a result of the development of heat between the opposing main flanks during relative movement between these flanks (which invariably occurs to a greater or a lesser extent as the flanks tend to separate and then impact against each other as they are subjected to the alternate tensile and compressive energy waves as previously discussed) and also to alleviate the likelihood of the main flanks from wedging one within the other during such use (thereby hindering uncoupling of the screw threads) it has been determined that the pitch angle (referred to as $\alpha$) should be calculated as a particular function of the flank angle $\beta$. The tangent of the pitch angle is the ratio of the pitch (P) to the circumference of the screw thread at the effective diameter thereof and for a given flank angle selected from the aforementioned range it has been determined that the pitch angle $\alpha$ may be calculated (or substantially so) from the formula:

$$\text{Sin } 2\alpha = \frac{-0.4 \text{ Cos } \beta \left( \frac{TU}{TC} - 1 \right)}{(0.04 + \text{Cos}^2 \beta) \left( \frac{TU}{TC} + 1 \right)}$$

where TU/TC is in the range 0.36 to 0.46 and provided that $\alpha$ is not greater than 9.5°. However, if for example for ease of manufacture the pitch angle $\alpha$ as applied in practice differs from the pitch angle $\alpha$ as determined theoretically it is preferred that the practical pitch angle is greater than the theoretical value.

Preferably the flank angle $\beta$ is 45° and TU/TC is 0.39 throughout the aforementioned range of effective diameter and from this the pitch angle $\alpha$ may be calculated from the formula as substantially 6.5°. However, at the extreme ends of the most preferred range of the flank angle $\beta$ (i.e. 40° to 50°) and with TU/TC being 0.39 it can be calculated that a flank angle $\beta$ of 40° will provide a pitch angle $\alpha$ of substantially 6.1° while a flank angle $\beta$ of 50° will provide a pitch angle $\alpha$ of substantially 7.1°. It is believed that a deviation in the pitch angle $\alpha$ from that which is determined theoretically (from the aforementioned formula and with the parameters of TU/TC being 0.39 and $\beta$ being in the range 40° to 50°) should preferably be maintained within a tolerance of ±0.3° since such a tolerance should not adversely affect, to a material extent, the desirable characteristics of the thread form.

It has also been determined that for optimum efficiency of the screw thread the radial extent of abutment (h) between the opposed main flanks 5 and 5' should be related to the effective diameter of the mating screw theads and preferably $$h = 8.06 \times 10^{-6} \phi^3 - 2.8 \times 10^{-3} \phi^2 + 0.27\phi - 5.07 \text{ (Millimeters).}$$

It is believed that in practice the value of h as applied to the screw thread may deviate from the theoretically determined value by ±10% without adversely affecting the thread characteristics to a material extent.

In view of the radiussed transition regions 10, 11 between the flanks and their respectively adjacent crests and roots on the mating screw threads 2, 9, the effective width of the crest 4 of the drill rod may be considered as the distance 'y' measured axially between the radially outermost edges of the main and secondary flanks 5, 7 respectively adjacent to the crest 4; similarly, the effective width of the crest 4' of the sleeve 8 may be considered as the distance 'x' measured axially between the radially innermost edges of the main and secondary flanks 5', 7' respectively adjacent to the crest 4'. From these considerations and as will be seen from FIG. 2 it can be determined that:

$$P = x + y + \epsilon + h \text{ (Tan } \gamma + \text{Tan } \beta)$$

The flank angle $\gamma$ for the secondary flank 7, 7' is preferably selected from the range 30° to 65° and is conveniently the same as the flank angle $\beta$. In the preferred construction $x = y$ and $\gamma = \beta = 45°$; from this it can be determined that $$P = \pi\phi \tan \alpha = 2x + \epsilon + 2h$$

From this latter equation the preferred crest widths x and y may be calculated when a value is applied for the endfloat $\epsilon$. In accordance with conventional practice of screw thread design the desirable endfloat $\epsilon$ may be determined experimentally; if $\epsilon$ is too small it is possible that there will be binding between the opposed secondary flanks 7 and 7' whereas if $\epsilon$ is too large there may be undue wear on the opposing secondary flanks in the event that these flanks impact against each other and chatter. This latter effect may occur if the joint is subjected to percussive blows without the opposing main flanks being urged into face-to-face abutment. As previously discussed it is intended that only the main flanks 5, 5' should abut during use of the drill elements 1 and 8 and when the screw threads 2 and 9 are firmly mated together (so that the rod 1 is maintained under compression while the sleeve 8 is maintained in tension by the forces which are transmitted axially through the abutting main flanks). It is possible however, if the joint is not adequately tightened (to provide the aforementioned compressive and tensile forces), for the secondary flanks 7 and 7′ to impact against each other during the application of percussive blows to the drill string and until such time as the joint becomes sufficiently tightened (usually as a result of the drill string being rotated in a drilling operation). Consequently although the profile of the secondary flanks 7, 7′ is regarded as being of considerably less importance than is the profile of the main flanks 5, 5′ to allow for the occasion in which the secondary flanks may move into face-to-face abutment with each other as aforementioned it is preferred that they are of a similar size and configuration to the main flanks on their respective threads. In the broad concept of the present invention however the secondary flanks 7, 7′ may have complementary convex or concave profiles, for example each may be of arcuate form which a large radius of curvature in axial section. For the drill elements in accordance with the present invention the endfloat $\epsilon$ is preferably selected from the range 0.5 millimeters to 0.9 millimeters.

It is preferred that the effective crest widths x and y are equal. In the event that these widths differ then desirably the effective crest width y of the male screw thread 2 on the drill rod is greater than the effective crest width x on the female screw thread 9. The reason for this latter preference is that the drill element having the female thread (particularly a coupling sleeve) is usually regarded as a less expensive and somewhat of a "throw-away" item as compared with the drill rod and such a difference in crest widths will likely cause the thread on the drill element having the smaller effective crest width to wear away to what may be regarded as a practically useless condition more rapidly than will the thread on the drill rod.

The amount of radial clearances C and C′ provided between the opposing roots and crests of the mating threads 2 and 9 is not considered particularly relevant to the characteristics of the screw threads. However these clearances should be controlled to the extent that the depth of the thread is not unnecessarily large to the extent that the drill element is unduly weakened—this is particularly so in respect of the male thread on the rod 1. For the drill element of the present invention the clearances C and C′ preferably increase from approximately 0.2 millimeters to approximately 1.0 millimeters as the selected effective diameter of the screw thread progressively increases from 25 millimeters to 65 millimeters. Since it is not intended that the opposing faces on the respective roots and crests should contact each other, these faces may be of a form other than flat in axial section as shown in FIG. 2, for example the crests may be of arcuate profile to provide a convex surface with a large radius of curvature while the roots may be of complementary concave profile. When applying alternative profiles to the faces of the roots and crests it is desirable that relative smooth bevelled or curved transition regions (similar to those shown at 10 and 11) are provided between the faces of the flanks and the faces of their respectively adjacent roots and crests so that when the threads are hardened, for example by carburising, it is unlikely that regions of excessive hardness will be created at the transition regions. This should alleviate the likelihood of the threads fracturing across the transition regions. It is preferred that the thread depth is the same for both the male thread (the drill rod) and the female thread (the coupling sleeve).

A most popular size of drill rod in current use has a nominal diameter (that is measured across the crest of the male thread) of 38 millimeters or 1.5 inches and this corresponds to an effective diameter $\phi$ of 35.4 millimeters. Applying the preferred characteristics of the present invention to such a drill size whereby both flank angles $\beta$ and $\gamma$ are 45° and TU/TC is 0.39 it can be determined from the formulae previously described that the pitch angle $\alpha$ should be 6.53°, that the pitch should be 12.7 millimeters and that the abutting flank height h should be 1.34 millimeters with effective crest widths x and y of 4.64 millimeters each (where an endfloat $\epsilon$ of 0.76 millimeters is provided). As previously mentioned, the figures which result from the theoretical calculations may be altered slightly during manufacture of the threads (provided that the ranges where specified are not exceeded) without materially adversely affecting the characteristics of the thread, for example although the pitch is theoretically determined as 12.7 millimeters the actual pitch as applied to the drill elements may be 13 millimeters as being more convenient to produce on existing thread forming equipment.

In the graph shown in FIG. 4 the most preferred relationship between the flank angle $\beta$ and the pitch angle $\alpha$ is shown by the line $P_1$ in which TU/TC=0.39 so that this line conforms to the equation:

$$\sin 2\alpha = \frac{0.24 \cos \beta}{(0.056 + 1.39 \cos^2 \beta)}$$

Our research has shown that the ratio between the uncoupling torque and the coupling torque (TU/TC) can lie in the range 0.36 to 0.46 and still provide a commercially viable and useful screw thread on a drill element of the kind specified for use with high torque drilling machines. We have found that if the ratio (TU/TC) is less than 0.36 a coupling formed by two drill elements having such threads will run too loose and tend to wear rapidly with the result that the coupling becomes over-heated and it is also likely that drill elements will be lost in the bore hole due to inadvertent unscrewing of the coupling; conversely with a ratio (TU/TC) greater than 0.46 we have found that the drill elements in the coupling tend to jam or wedge together when used with high torque drilling machines (even though we have found that a ratio TU/TC of 0.55 on drill elements having a single start standard rope or buttress thread form are suitable for use with conventional low torque drilling machines—that is machines which develop a torque in the order of 150 lbs feet). Therefore in the graph of FIG. 4, line $P_2$ relates to a ratio TU/TC of 0.36 and is drawn in accordance with the equation:

$$\sin 2\alpha = \frac{0.26 \cos \beta}{(0.054 + 1.36 \cos^2 \beta)}$$

and line $P_3$ relates to a ratio TU/TC of 0.46 and is drawn in accordance with the equation:

$$\sin 2\alpha = \frac{0.22 \cos \beta}{(0.58 + 1.46 \cos^2 \beta)}$$

Therefore it is our belief that the region of the graph falling between the lines $P_2$ and $P_3$ will include an area from which the related flank angle $\beta$ and pitch angle $\alpha$ may be selected in the manufacture of a screw thread for a drill element of the kind specified and which thread will be commercially useful when used with high torque drilling machines. To determine the extent of the useful area between the lines $P_2$ and $P_3$ we revert to our previous discussion concerning the "bounds of utility" for the ranges of flank angle and pitch angle within which the screw thread should be constructed when manufacturing a drill element of the kind specified; that is to say the flank angle $\beta$ should lie within the range 30° to 65° and the pitch angle $\alpha$ should lie within the range 4.5° to 9.5° and these parameters are indicated by the chain lines forming the large rectangular box DLMND on the accompanying graph. Our discovery is therefore that a drill element of the kind specified and which will be commercially useful for use with high torque rotary percussive drilling machines and will alleviate the previously discussed problems normally encountered on drill elements when used on such machines, will be provided when the screw thread has a root and a crest which are interconnected through a main flank, when the screw thread has an effective diameter selected from the range 25 mms to 65 mms, when, in a section of the screw thread taken on the longitudinal axis thereof, the main flank is flat (or substantially flat) and is inclined at a flank angle $\beta$ to a plane which is normal to the longitudinal axis, and when the flank angle $\beta$ and pitch angle $\alpha$ of the screw thread are those which correspond to a point selected in the area bounded by the lines ABCDEA in the graph of FIG. 4 (such area being shown hatched). For the avoidance of doubt line AB extends between $P_2$ and $P_3$ for a constant flank angle $\beta$ of 30°; line BC extends along $P_2$ from $\beta=30°$ to $\alpha=9.5°$; line CD corresponds to a constant pitch angle $\alpha$ of 9.5° from the intersection with $P_2$ to flank angle $\beta=65°$; line DE corresponds to a constant flank angle $\beta$ of 65° extending from a position corresponding to $\alpha=9.5°$ to the intersection with $P_3$ and line EA corresponds to line $P_3$ extending from $\beta=30°$ to $\beta=65°$.

Consequently although the area on the accompanying graph which is enclosed by the box DLMND indicates the bounds of utility for determining particular flank and pitch angles in the manufacture of a drill element, we have discovered that within this area there is a significantly smaller area enclosed by the lines ABCDEA within which the relationship between the flank and pitch angles should be selected for manufacture of a viable and commercially useful drill element (that is to say the relationship between the flank angle and pitch angle selected from a point on the graph which is outside the area ABCDEA is of significantly less value than such relationship resulting from a point which is selected inside the aforementioned area). This discovery that the pitch angle may easily and accurately be determined for a particular flank angle $\beta$ whilst maintaining a ratio between the uncoupling torque and the coupling torque within predetermined limits undoubtedly facilitates the manufacture of drill elements suitable for use with high torque drilling machines is, we believe, a considerable advance in the art. This is especially so bearing in mind the hitherto practice of designing threads for drill elements on a somewhat "hit and miss" basis (that is for determining the relationship between the flank and pitch angles) whereby once a suitable thread form had been developed there was no rhyme or reason how a further thread form, for example of a different effective diameter, should be constructed to retain the desirable properties of the original thread form.

We are aware of U.K. Patent Specification No. 1,326,345 which may be regarded as being directed towards a drill element of the kind specified in which the flank angle $\beta$ of the main flank is to be selected from the range 50° to 65° while the pitch angle is selected from the range 6.5° to 9°; this region of alleged usefulness from which the flank angle and the pitch angle may be selected at random for manufacture of a drill element in accordance with Specification No. 1,326,345 is indicated on the accompanying graph by the solid lines forming the smaller rectangle FGHIF. However, in Specification No. 1,326,345 there is absolutely no indication or guidance as to why a screw thread having parameters determined by one particular point within the area FGHIF should be any better or any worse than any other particular point in that area nor is any relationship given between the various points in that area. As will be seen from the graph the hatched area (which indicates the extent of usefulness which we have discovered in determining particular parameters for manufacture of a drill element thread) extends over approximately half of the area FGHIF so it is our belief that there are innumerous drill elements having different combinations of flank angle and pitch angle which can be selected at random from within the area FGHIF (but outside the hatched area) which are of considerably less value than drill elements having parameters selected from points within the hatched area. Although Specification No. 1,326,345 does not distinguish between different points in the area FGHIF it does mention, by way of example, a screw thread in which the flank angle $\beta$ is 55° and the pitch angle $\alpha$ is 8° (indicated at "y" on the accompanying graph) and it is to be understood that any claim to our invention is not intended to include in its scope the particular point "y"; nor is it our intention to include any claim to the particular point (indicated at "x") corresponding to a flank angle $\beta$ of 55° and a pitch angle $\alpha$ of 7.8° which we are aware as being the parameters adopted in a drill element manufactured, we understand, as a practical embodiment of the example in Specification No. 1,326,345. Whilst disclaiming these two points indicated within the circles "x" and "y" on the accompanying graph it is significant to note that both points are well within the hatched area ABCDEA and in fact one of the points is substantially on our most preferred line $P_1$; consequently even though, so far as the reader of Specification No. 1,326,345 is concerned, there is no rhyme or reason why a drill element with a screw thread made of appropriate diameter and in accordance with the parameters determined from point "x" or point "y" should work efficiently with a high torque rotary percussion drilling machine, by our discovery of the relationship between the coupling/uncoupling torque, the flank angle and pitch angles we know now why it can reasonably be expected for the points x and y to provide efficient threads for drill elements. Indeed, during the assessment of drill elements constructed in accordance with our invention we also manufactured for test and comparison purposes drill elements of the kind specified but having parameters of flank angle $\beta$ and pitch angle $\alpha$ selected from points within or adjacent to the rectangular area DLMND but outside the area ABCDEA on the graph in FIG. 4. In these comparison tests, and by way of example, four different complementary engaging drill rod/sleeve couplings were manufactured substantially as shown in FIGS. 2 and 3 and in each coupling the effective diameter of the screw thread was substantially 35.4 millimeters (corresponding to a nominal diameter of 38 millimeters); however a first coupling had its screw threads with a pitch angle ($\alpha$) of 7.14° and a flank angle ($\beta$) of 63°, a second coupling had its screw threads with a pitch angle of 9.68° and a flank angle of 58°, a third coupling had its screw threads with a pitch angle of 8.15° and a flank angle of 51° and the fourth coupling had its screw thread with a pitch angle of 6.13° and a flank angle of 28° (these four test screw threads are respectively indicated at points M', L', N', and J' on the graph of FIG. 4). The screw threads M', L', N' and J' had substantially flat secondary flanks inclined at flank angles ($\gamma$) of 30°, 60°, 60° and 60° respectively. Following repeated test drillings of the four test couplings in a standard and conventional high torque percussive drilling machine it was found that the couplings having the screw threads J', L' and N' all ran too loose causing excessive heat build-up and generating unacceptable longitudinal (axial) differential movement between the elements of the respective couplings (which differential movement caused deformation of the secondary flanks due to their abutment on take-up of the endfloat). The coupling having the M' screw thread however, showed no evidence of longitudinal differential movement between its drill elements, on the contrary soon after test drilling had commenced the coupling formed an unacceptably tight joint which was extremely difficult to uncouple and at the end of the testing a degree of welding was indicated between the drill elements.

In comparison, drill elements made in accordance with the present invention and substantially as described with reference to FIGS. 1 to 4 were subjected to similar testing as that applied to the screw threads M', L', N' and J' and it was found that such elements provided results which were fully acceptable in practice and clearly alleviated the disadvantages which resulted from the screw threads M', L', N' and J'. However as a result of the test programme to which the various drill elements were subjected it became apparent that drill elements of the present invention and having a flank angle $\beta$ in the range of 30° to 60° were even more efficient in alleviating the previously discussed difficulties than were such drill elements having a flank angle $\beta$ in the range of 60° to 65°. For this reason it is preferred that the parameters of $\alpha$ and $\beta$ for a drill element in accordance with the present invention are selected from a point within the area bounded by the lines ABCWA on the graph of FIG. 4.

Indicated on the graph in FIG. 4 is an area bounded by the lines JKLMJ which corresponds to the parameters for screw threads of the most preferred drill elements of the present invention where the flank angle $\beta$ is in the range 40° to 50° and the pitch angle is in the range $\alpha \pm 0.3°$, $\alpha$ being determined from the previously given formula where TU/TC is 0.39.

To provide efficient coupling between the drill rod 1 and the female threaded drill element with which it mates it is considered necessary that the opposing main flanks are urged into face-to-face abutment to the extent that, when the lead-in end of the drill rod is restricted by its abutment against the female threaded drill element from further entry into the female element, the application of further torque to the drill rod imparts an axially directed thrust (through the abutting main flanks) to the wall of the female threaded elements so causing the latter to be tensioned while the screw threaded end of the drill rod is urged in compression. With this in mind the lead-in end of the drill rod 1 can be provided with a cylindrical nose 12 having a flat end face 13 located in a radial plane of the axis 6. The nose 12 communicates with a relatively enlarged diameter portion 14 of the rod through a frusto conical bearing surface 15. The portion 14 is conveniently of substantially the same diameter as the root 3. The bearing surface 15 is located axially between the end face 13 and the screw thread 2 and is un-interrupted throughout its circumferential extent (especially in so far as the screw thread 2 does not run-out into the bearing surface). The drill rod 1 is coupled with a female threaded element which is conveniently regarded as the tubular sleeve 8 as shown in FIG. 3. The sleeve 8 is provided with a radially inwardly directed shoulder 16 carrying a frusto conical bearing surface 17 which is complementary to the bearing surface 15 on the rod. The rod 1 is screwed into the sleeve 8 until its bearing surface 15 abuts in face-to-face relationship with the bearing surface 17 and the nose 12 is received within a cylindrical bore 18 in the shoulder 16 which bore is slightly larger than, and provides clearance with, the nose 12. The frusto conical bearing surfaces 15 and 17, nose 12 and bore 18 are concentric with the axes of the screw threads on their respective drilling elements so that the face-to-face abutment between the surfaces 15 and 17 causes the drill rod 1 to be centralised in the female thread of the sleeve 8. Upon tightening the drill rod into the sleeve 8, the bearing surface 17 restrains entry of the screw thread 2 and this results in a reaction being effected axially through the abutting main flanks which acts to tension the wall of the sleeve 8 and thereby apply compression through the drill rod from its main flank 5 to the bearing surface 17. In addition the frusto conical and symmetrical area of abutment between the un-interrupted faces of the bearing surface 15 and 17 ensures that when the joint is tightened and subjected to impacts which are directed axially through the drill string, the forces which are transmitted through the abutting bearing surfaces 15 and 17 are symmetrical about the axis of the screw threads. By this latter arrangement there is alleviated the development of off-set forces between the mating threads (which off-set forces tend to create instability in the drill string and uneven wear at localised regions of engagement between the drill rod and sleeve). The frusto conical complementary bearing surfaces 15 and 17 are preferably in the range 25° to 35° (and in the present example are at 30°) to the axes of their respective drill elements.

As shown in FIG. 3, the righthand end part length of the tubular sleeve 8 is provided with the internal screw thread 9 receiving the drill rod 1 and the lefthand end part length is of similar form, being provided with an identical internal lefthand screw thread 9'. The thread 9' has associated therewith a frusto conical bearing surface 17' located on the shoulder 16 the latter of which is positioned at the mid part length of the sleeve. To extend the length of a drill string the end of a further drill rod 1' ( which is identical in structure to the end of the drill rod 1 and on which similar parts to those on the drill rod 1 are conveniently shown by dashed references) is screwed into the lefthand end of the sleeve 8 until its flat leading end face 13' abuts in face-to-face contact with the end face 13 of the rod 1. This abutment between the opposed end faces restrains entry of the drill rod 1' into the sleeve so that, upon further tightening of the rod 1' into the sleeve, the opposing main flanks of the thread 2' on the rod 1' and the thread 9' of the sleeve are urged into abutment. The axial reaction from this latter abutment imparts a tensioning effect in the wall of the sleeve 8 and a compression effect in the drill rod 1' between the main flank thereof and its end face 13'. By arranging for the flat end faces on the noses of the rods 1 and 1' to be urged into face-to-face abutment it may be ensured that during percussion drilling the major proportion of energy is transmitted axially between the drill rods and through the abutting end faces rather than through the wall of the sleeve 8. It will be noted that the frusto conical bearing surface of the rod 1' is axially clear of the bearing surface 17' to ensure that the flat end faces 13 and 13' can abut against each other.

Should percussion drilling be effected when the joint formed by the coupling 8 and rods 1, 1' is not tight (so that the flat end faces 13 and 13' are not urged into abutment with each other), it is possible that the force which is transmitted from the impact and through the drill string will cause one or both of the drill rods to be displaced axially relative to the sleeve 8 and to the extent permissible by the previously mentioned endfloat ($\epsilon$). Upon this endfloat being taken up the impact energy transfer across the joint will occur predominantly through the abutting secondary flanks between the respectively mating male and female threads. It is for this reason that the secondary flanks are preferably of a similar size and geometrical structure to the main flanks to ensure that the possibility is alleviated of the secondary flanks becoming wedged together for the period during which they may be operative. Usually the joint is tightened automatically as a result of rotation of the drill string during percussion drilling.

In certain instances, and bearing in mind that drill rods are usually tubular for the passage therethrough of flushing fluid, the diameter of the drill rod may be insufficient to accommodate a frusto conical bearing surface 15 which has an adequate surface area with an acceptable angle of inclination to the rod axis and which will provide an acceptable area to the end face 13 (this is a particular possibility for drill rods having an effective diameter less than, say, 51 millimeters); as a consequence therefore the particular nose formation of the drill rod and the complementary formation in the drill sleeve as above described are to be considered as possible modifications which can be omitted from the drill elements of the present invention as described with reference to the accompanying illustrative drawings.

In the following claims a drill element with a flank angle $\beta$ of 55° and a pitch angle $\alpha$ of 8° and a drill element with a flank angle $\beta$ of 55° and a pitch angle $\alpha$ of 7.8° are disclaimed and subject to this disclaimer.

What we claim is:

1. A drill element of the kind specified in which the screw thread has a root and a crest which are interconnected through a main flank, an effective diameter selected from the range 25 millimeters to 65 millimeters and a pitch angle $\alpha$ and in which, in a section of the screw thread taken on the longitudinal axis thereof, the main flank is flat or substantially flat and is inclined at a flank angle $\beta$ to a plane which is normal to the longitudinal axis and wherein $\alpha$ is determined, or substantially so, from the formula $$\sin 2\alpha = \frac{-0.4 \cos\beta \left(\frac{TU}{TC} - 1\right)}{(0.04 + \cos^2\beta)\left(\frac{TU}{TC} + 1\right)}$$

where TU is the uncoupling torque, TC is the coupling torque, TU/TC is in the range 0.36 to 0.46; $\beta$ is in the range of 30° to 65°, and $\alpha$ as determined is not greater than 9.5°.

2. A drill element as claimed in claim 1 in which $\beta$ is in the range 30° to 60°.

3. A drill element as claimed in claim 2 in which $\beta$ is in the range 50° to 60° and $\alpha$ as determined is not less than 6.5°.

4. A drill element as claimed in claim 2 in which $\beta$ is in the range 30° to 54° and with $\beta$ in the range 50° to 54° $\alpha$ as determined is not greater than 6.5°.

5. A drill element as claimed in claim 4 in which $\beta$ is in the range 40° to 50°, TU/TC is 0.39 and the pitch angle $\alpha$ is as determined from the formula with a tolerance in the range ±0.3°.

6. A drill element as claimed in claim 1 and having a flank angle $\beta$ of substantially 45° and a pitch angle $\alpha$ of substantially 6.5°.

7. A drill element as claimed in claim 1 in which the extent or height measured radially over which the main flank is intended to abut an opposing complementary main flank in a male/female coupling of two of the drill elements lies within the range H∓ 10%, h being determined from the formula $$h = 8.06\times10^{-6}\phi^3 - 2.8\times10^{-3}\phi^2 + 0.27\phi - 5.07$$

wherein $\phi$ is the effective diameter in millimeters.

8. A drill element as claimed in claim 1 in which the crest and root are flat, or substantially flat, in a section of the screw thread taken on the longitudinal axis thereof whereby said crest and root respectively lie in the surfaces of notional cylinders which are concentric with the thread axis.

9. A drill element as claimed in claim 1 in which the crest extends between the main flank and a secondary flank, said secondary flank being flat, or substantially flat, in a section of the screw thread taken on the longitudinal axis thereof and being inclined at a flank angle $\gamma$ to a plane which is normal to the longitudinal axis of the screw thread so that the main flank and secondary flank converge towards each other as they approach the crest which communicates between said flanks, and wherein the flank angle $\gamma$ is in the range of 30° to 65°.

10. A drill element as claimed in claim 9 in which transition regions are provided on the screw thread between the secondary flank and the adjacent crest and between the secondary flank and the adjacent root, said transition regions being of a chamfered or fair curved profile which alleviates the formation of an abrupt change in direction of the thread surface.

11. A drill element as claimed in claim 1 wherein the flank angle $\gamma$ is substantially the same as the flank angle $\beta$.

12. A drill element as claimed in claim 11 in which the pitch of the thread form is substantially symmetrical in the axial direction of the screw thread about the mid-axial width position of the crest.

13. A drill element as claimed in claim 1 in which transition regions are provided on the screw thread between the main flank and the adjacent crest and between the main flank and the adjacent root, said transition regions being of a chamfered or fair curved profile which alleviates the formation of an abrupt change in direction of the thread surface.

14. A drill element as claimed in claim 13 in which the transition regions are radiussed to provide convex surfaces between the crest and adjacent flanks and concave surfaces between the root and adjacent flanks.

15. A drill element as claimed in claim 14 in which the radii of the transition regions is selected from the range 1.5 millimeters to 3.5 millimeters.

16. The combination of two drill elements each of which is as claimed in claim 1, a first of said drill elements having its screw thread internal and the second drill element having its screw thread external, said screw threads being complementary and engageable, or in engagement, with each other so that the main flank of one drill element opposes and is capable of, or is in, substantially face-to-face and sliding abutment with the main flank of the other drill element.

17. The combination of two drill elements as claimed in claim 16 in which the thread forms of the two drill elements are substantially the same and for each thread form the crest extends between the main flank and a secondary flank, said secondary flank being flat, or substantially flat, in a section of the screw thread taken on the longitudinal axis thereof and being inclined at a flank angle $\gamma$ to a plane which is normal to the longitudinal axis of the screw thread so that the main flank and secondary flank converge towards each other as they approach the crest which communicates between said flanks, and the flank angle $\gamma$ is in the range of 30° to 65°, and wherein the opposing secondary flanks are in axially spaced relationship when the opposing main flanks are in abutment to provide an endfloat which measured in the axial direction is in the range 0.5 millimeters to 0.9 millimeters.

18. A drill element as claimed in claim 10 in which the transition regions are radiussed to provide convex surfaces between the crest and adjacent flanks and concave surfaces between the root and adjacent flanks.

19. A drill element as claimed in claim 18 in which the radii of the transition regions is selected from the range 1.5 millimeters to 3.5 millimeters.

* * * * *